US009926157B2

(12) United States Patent
Sugawara et al.

(10) Patent No.: US 9,926,157 B2
(45) Date of Patent: Mar. 27, 2018

(54) SHEET FEEDER, IMAGE FORMING APPARATUS INCORPORATING THE SHEET FEEDER, AND IMAGE FORMING SYSTEM INCORPORATING THE SHEET FEEDER

(71) Applicants: Tatsuya Sugawara, Kanagawa (JP); Takashi Fukumoto, Kanagawa (JP); Hideaki Takahashi, Kanagawa (JP); Hidetoshi Kojima, Kanagawa (JP)

(72) Inventors: Tatsuya Sugawara, Kanagawa (JP); Takashi Fukumoto, Kanagawa (JP); Hideaki Takahashi, Kanagawa (JP); Hidetoshi Kojima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/364,805

(22) Filed: Nov. 30, 2016

(65) Prior Publication Data

US 2017/0160689 A1 Jun. 8, 2017

(30) Foreign Application Priority Data

Dec. 7, 2015 (JP) ..... 2015-238880

(51) Int. Cl.
*B65H 7/14* (2006.01)
*G03G 15/00* (2006.01)
(Continued)

(52) U.S. Cl.
CPC ..... *B65H 7/14* (2013.01); *B65H 1/18* (2013.01); *B65H 3/14* (2013.01); *B65H 3/48* (2013.01);
(Continued)

(58) Field of Classification Search
CPC . B65H 3/10; B65H 3/12; B65H 3/128; B65H 3/14; B65H 3/48; B65H 3/64;
(Continued)

(56) References Cited

U.S. PATENT DOCUMENTS 7,267,337 B2 * 9/2007 Moore ..... B65H 1/18 271/148
7,635,125 B2 * 12/2009 Ikeda ..... B65H 1/14 271/152
(Continued)

FOREIGN PATENT DOCUMENTS

JP 2014-148379 8/2014
JP 2014-152023 8/2014
(Continued)

*Primary Examiner* — Ernesto A Suarez
(74) *Attorney, Agent, or Firm* — Harness, Dickey & Pierce, P.L.C.

(57) ABSTRACT

A sheet feeder, which is included in an image forming apparatus and an image forming system, includes a sheet loader on which a sheet bundle is loaded, an air blower to blow air to the sheet bundle loaded on the sheet loader and float upper sheets of the sheet bundle, a loader elevation device to lift and lower the sheet loader, a reflective optical detector including a first reflective optical detector to detect the upper sheets floated by the air blower and a second reflective optical detector to detect multiple floating sheets located below the floating sheets detected by the first reflective optical detector, and a controller configured to control the loader elevation device to perform a lifting operation of the sheet loader based on a combination of an output value of the first reflective optical detector and an output value of the second reflective optical detector.

20 Claims, 7 Drawing Sheets

(51) Int. Cl.

| | |
|---|---|
| ***B65H 3/14*** | (2006.01) |
| ***B65H 1/18*** | (2006.01) |
| ***B65H 3/48*** | (2006.01) |
| ***B65H 7/20*** | (2006.01) |

(52) U.S. Cl.
CPC ..... *B65H 7/20* (2013.01); *G03G 15/6511* (2013.01); *B65H 2301/4461* (2013.01); *B65H 2511/152* (2013.01); *G03G 15/6529* (2013.01)

(58) Field of Classification Search
CPC ... B65H 7/02; B65H 7/04; B65H 7/16; B65H 7/20; B65H 2301/4461; B65H 2511/152
See application file for complete search history.

(56) References Cited

U.S. PATENT DOCUMENTS

| | | | | |
|---|---|---|---|---|
| 7,832,720 | B2 * | 11/2010 | Fujita | B65H 1/14 271/155 |
| 7,850,162 | B2 * | 12/2010 | Imai | B65H 1/14 271/31 |
| 8,833,754 | B2 * | 9/2014 | Inoue | B65H 1/14 271/169 |
| 9,199,810 | B2 * | 12/2015 | Shimoyama | B65H 3/128 |
| 9,272,863 | B2 * | 3/2016 | Shimoyama | B65H 7/14 |
| 9,340,384 | B2 * | 5/2016 | Yabuki | B65H 3/128 |
| 9,771,228 | B2 * | 9/2017 | Mizuno | B65H 5/224 |
| 2009/0014948 | A1 | 1/2009 | Takahashi | |
| 2014/0339759 | A1 | 11/2014 | Takahashi et al. | |
| 2014/0346728 | A1 | 11/2014 | Fuda et al. | |
| 2015/0166280 | A1 | 6/2015 | Hino et al. | |
| 2015/0225191 | A1 | 8/2015 | Niikura et al. | |
| 2017/0174453 | A1 * | 6/2017 | Akai | B65H 3/128 |

FOREIGN PATENT DOCUMENTS

| | | |
|---|---|---|
| JP | 2014-156310 | 8/2014 |
| JP | 2014-172702 | 9/2014 |
| JP | 2014-172703 | 9/2014 |
| JP | 2015-009926 | 1/2015 |
| JP | 2015-110464 | 6/2015 |
| JP | 2015-134685 | 7/2015 |

* cited by examiner

SHEET FEEDER, IMAGE FORMING APPARATUS INCORPORATING THE SHEET FEEDER, AND IMAGE FORMING SYSTEM INCORPORATING THE SHEET FEEDER

CROSS-REFERENCE TO RELATED APPLICATION

This patent application is based on and claims priority pursuant to 35 U.S.C. § 119(a) to Japanese Patent Application No. 2015-238880, filed on Dec. 7, 2015, in the Japan Patent Office, the entire disclosure of which is hereby incorporated by reference herein.

BACKGROUND

Technical Field

This disclosure relates to a sheet feeder, an image forming apparatus incorporating the sheet feeder, and an image forming system incorporating the sheet feeder.

Related Art

Various types of electrophotographic image forming apparatus are known to include a sheet feeder to feed sheets to an image forming device from a sheet loader on which a bundle of sheets are loaded. In the sheet feeder, an upper sheet placed on the bundle of sheets on the sheet loader is lifted by air blown from an air blowing device, so that the floating sheet is conveyed one by one by a conveying member such as an attraction belt. Such a sheet feeder has a sheet detection technique in which, when multiple upper sheets are lifted by air from the air blowing device, a sheet detection sensor such as a reflective optical sensor detects the side face of the multiple sheets, so as to move the sheet loader vertically (elevate and lower) according to the output value of the reflective optical sensor.

For example, a comparative sheet feeder includes a reflective optical sensor to detect multiple sheets in a range of from an upper face of a bundle of non floating sheets including sheets not floating in the air while the air blowing device blows air to the conveying member. Hereinafter, the range is referred to as a "sheet floating region". The comparative sheet feeder further includes a lifting device to move the sheet loader up and down in a vertical direction and a controller to control the lifting device according to the output value of the sheet detection sensor.

The comparative sheet feeder detects the density of floating sheets in the sheet floating region (full or empty of floating sheets) according to the output value of the sheet detection sensor. When the number of floating sheets is decreased to a certain amount, the controller causes the sheet loader to elevate. By so doing, elevation of the bundle of floating sheets is controlled so as to float the specified number of sheets.

As the number of sheets loaded on the sheet loader decreases and approaches an empty state in which a single and last sheet remains, an interval of floating sheets increases to cause the space density of the floating sheets in the sheet floating region to become low. In this state, an uppermost sheet does not approach an attraction belt, and it is likely to cause sheet feed failure. When a remaining amount of sheets loaded on the sheet loader is less than a threshold value, the comparative sheet feeder sets a greater amount of sheets in the sheet loader than a regular amount of elevation. According to this configuration, the space density of floating sheets in the sheet floating region is made to be the specified value. Therefore, even if the remaining amount of sheets is small and a sheet feeding cycle is short, the comparative sheet feeder can cause the sheet to attract to the attraction belt by a subsequent sheet conveying timing.

SUMMARY

At least one aspect of this disclosure provides a sheet feeder including a sheet loader, an air blower, a loader elevation device, a reflective optical detector, and a controller. A sheet bundle is loaded on the sheet loader. The air blower blows air to the sheet bundle loaded on the sheet loader and float upper sheets of the sheet bundle. The reflective optical detector including a first reflective optical detector configured to detect the upper sheets floated by the air blower, and a second reflective optical detector configured to detect multiple floating sheets located below the floating sheets detected by the first reflective optical detector. The controller controlled configured to control the loader elevation device to perform a lifting operation of the sheet loader based on a combination of an output value of the first reflective optical detector and an output value of the second reflective optical detector.

Further, at least one aspect of this disclosure provides an image forming apparatus including an image forming device to form an image on a surface of a sheet, and the above-described sheet feeder to feed the sheet to the image forming device.

Further, at least one aspect of this disclosure provides an image forming system including an image forming apparatus including an image forming device to form an image on a surface of a sheet, and the above-described sheet feeder to feed the sheet to the image forming device.

DETAILED DESCRIPTION

Figure 1:
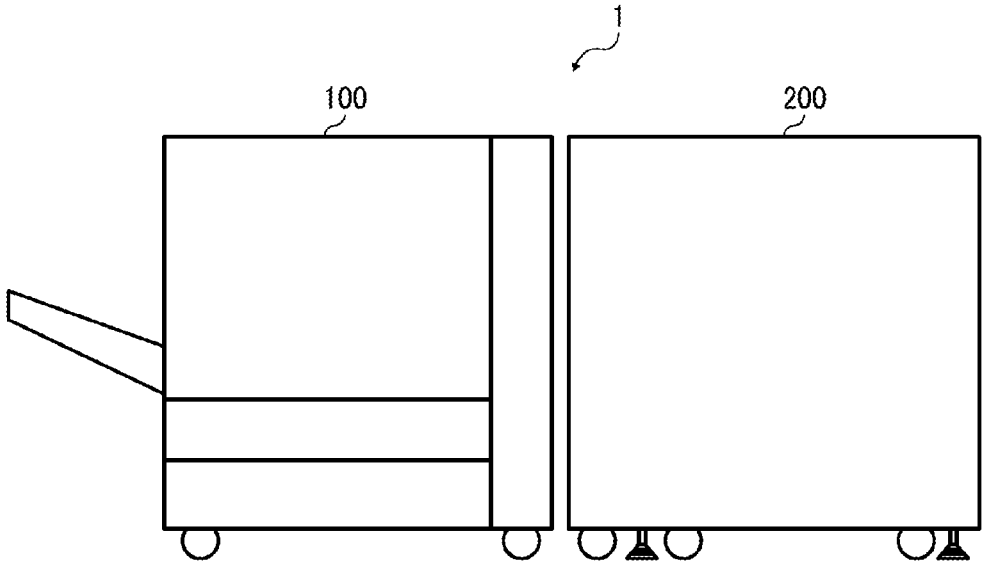
FIG. 1 is a diagram illustrating a schematic configuration of an image forming system according to an embodiment of this disclosure.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a sheet feeding device 200 according to an embodiment of this disclosure.

FIG. 1 is a diagram illustrating a schematic configuration of an image forming system 1 according to an embodiment of this disclosure.

As illustrated in FIG. 1, the image forming system 1 includes an image forming apparatus 100 to form an image on a sheet and the sheet feeding device 200 (see FIG. 3) to feed the sheet to the image forming apparatus 100. The sheet feeding device 200 is disposed at a side face of a housing of the image forming apparatus 100.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Now, a description is given of an entire configuration and functions of the image forming apparatus 100 according to an embodiment of this disclosure.

Figure 2:
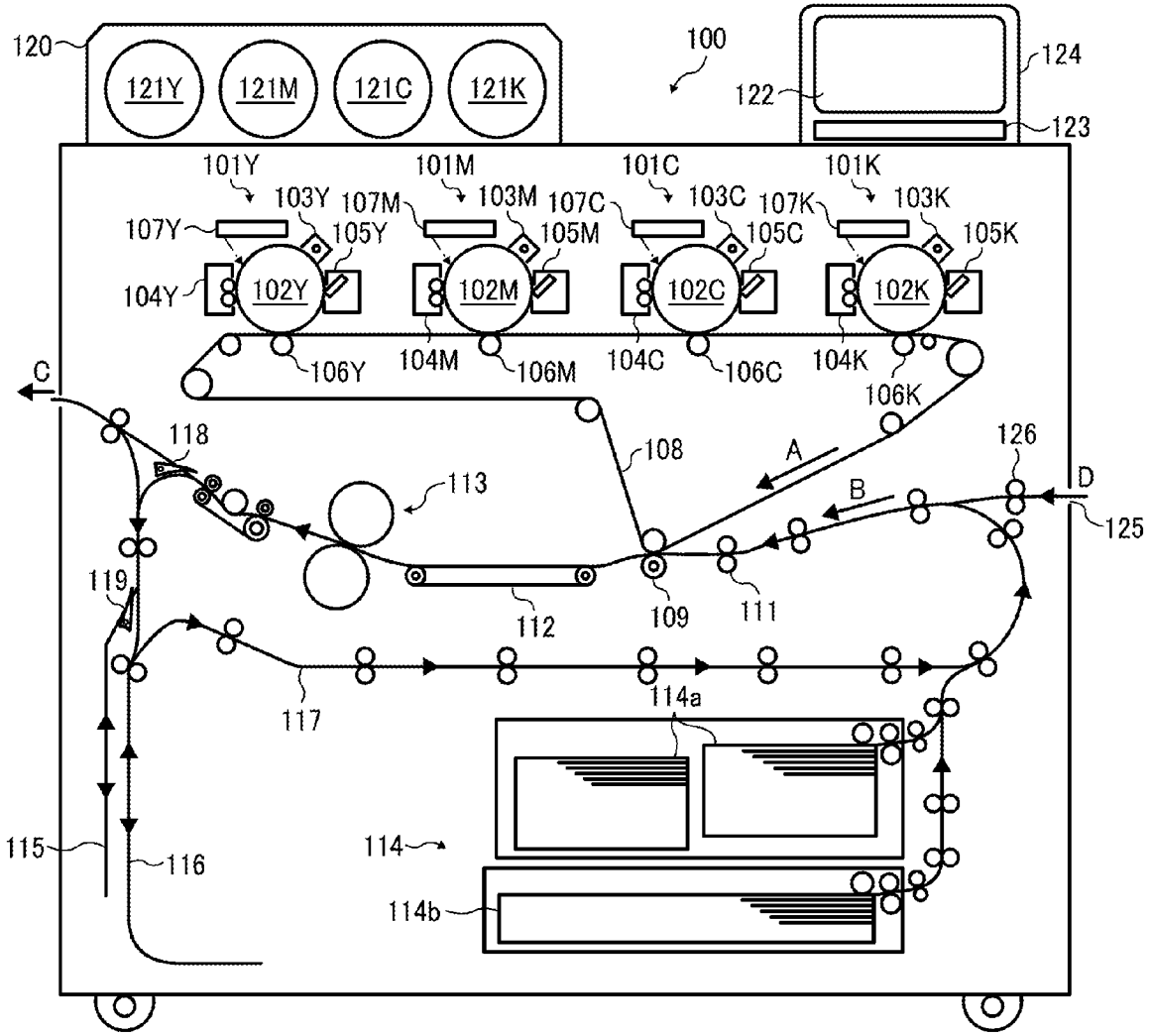
FIG. 2 is a diagram illustrating a schematic configuration of an image forming apparatus according to an embodiment of this disclosure.

FIG. 2 is a schematic diagram illustrating the image forming apparatus 100 according to the present embodiment of this disclosure.

The image forming apparatus 100 has printing and copying functions for forming a full color image with four color toners such as yellow (Y), cyan (C), magenta (M), and black (K).

As illustrated in FIG. 2, the image forming apparatus 100 includes four image forming units 101Y, 101M, 101C, and 101K. The image forming units 101Y, 101M, 101C, and 101K that form respective single color images are aligned at an upper part of a housing of the image forming apparatus 100. The image forming units 101Y, 101M, 101C, and 101K have a substantially identical configuration and functions to each other. Therefore, following details of the image forming units 101Y, 101M, 101C, and 101K are described with a single image forming unit that corresponds to each of the image forming units 101Y, 101M, 101C, and 101K, without the suffixes Y, M, C, and K indicating respective colors. The image forming unit 101 (i.e., the image forming units 101Y, 101M, 101C, and 101K) includes a photoconductor drum 102 (i.e., photoconductor drums 102Y, 102M, 102C, and 102K), a charger 103 (i.e., chargers 103Y, 103M, 103C, and 103K), and a cleaning device 105 (i.e., cleaning devices 105Y, 105M, 105C, and 105K). The charger 103, the developing device 104, and the cleaning device 105 are disposed around the photoconductor drum 102.

Further, an optical writing device 107 is disposed above the photoconductor drum 102.

An intermediate transfer belt 108 is disposed below the image forming units 101Y, 101M, 101C, and 101K. The intermediate transfer belt 108 is wound around multiple support rollers. As one of the multiple support rollers is driven by a drive unit, the intermediate transfer belt 108 is rotated in a direction indicated by arrow A in FIG. 2.

A transfer roller 106 (i.e., transfer rollers 106Y, 106M, 106C, and 106K) that functions as a primary transfer unit is disposed facing the photoconductor drum 102 of the image forming unit 101 with the intermediate transfer belt 108 interposed therebetween. When the transfer roller 106 and the photoconductor drum 102 contact with the intermediate transfer belt 108 interposed therebetween, a primary transfer portion is formed to primarily transfer the toner image onto the photoconductor drum 102.

In the image forming unit 101, the photoconductor drum 102 is rotated in a counterclockwise direction in FIG. 2. Then, the charger 103 uniformly charges a surface of the photoconductor drum 102 to a predetermined polarity. Then, an optically modulated laser light beam is emitted from the optical writing device 107, so that an electrostatic latent image is formed on the charged surface of the photoconductor drum 102. The electrostatic latent image is developed with toner applied by the developing device 104 into a visible toner image. The visible toner images of respective single colors formed by the image forming units 101Y, 101M, 101C, and 101K are sequentially transferred in layers onto a surface of the intermediate transfer belt 108.

By contrast, a sheet feeding section 114 is disposed in a lower part of the housing of the image forming apparatus 100. The sheet feeding section 114 includes sheet trays 114*a* and 114*b*. A sheet that functions as a recording medium is fed out from one of the sheet feeding section 114 and the sheet feeding device 200 that is attached to the image forming apparatus 100. The fed sheet is conveyed to a pair of registration rollers 111 in a direction indicated by arrow B in FIG. 2.

The sheet contacted and temporarily stopped at the pair of registration rollers 111 is fed out from the pair of registration rollers 111 in synchronization with movement of the toner image formed on the surface of the intermediate transfer belt 108. Then, the sheet is conveyed to a secondary transfer portion where a secondary transfer roller 109 contacts the intermediate transfer belt 108. A voltage having an opposite polarity to a toner charge polarity is applied to the secondary transfer roller 109. By so doing, the composite toner image (the full color image) formed on the surface of the intermediate transfer belt 108 is transferred onto the sheet. After the toner image has been transferred thereto, the sheet is conveyed by a sheet conveying belt 112 to a fixing device 113. In the fixing device 113, the toner image is fixed to the sheet by application of heat and pressure. After the toner image is fixed thereto, the sheet is ejected out of the apparatus body of the image forming apparatus 100 as indicated by arrow C in FIG. 2 onto a sheet ejection tray.

It is to be noted that, when the sheet is ejected with the back of the sheet facing up in the single-side printing (a face down ejection), the sides of the sheet are reversed by ejecting the sheet outside the apparatus body of the image forming apparatus 100 as indicated by arrow C in FIG. 2 via a sheet reverse portion 115. Further, in the duplex printing, the sheet after the toner image has been fixed thereto is conveyed via a duplex reverse portion 116 from a reentry path 117 to the pair of registration rollers 111 again. By so doing, a toner image formed on the surface of the intermediate transfer belt 108 is transferred onto the back of the sheet.

After the toner image has been transferred onto the sheet, the toner image is fixed to the sheet in the fixing device 113. Then, similar to the single-side printing, the sheet is ejected out in the direction C in FIG. 1 directly from the fixing device 115 or via the sheet reverse portion 115. In addition, switching claws 118 and 119 are disposed appropriately to switch a sheet conveying direction.

In a case of a monochrome printing, the image forming apparatus 100 according to the present embodiment uses the image forming unit 101K to form a monochrome toner image and transfers the monochrome toner image onto a sheet via the intermediate transfer belt 108. A sheet having a monochrome toner image thereon is handled along the same process as a sheet having a full color toner image after the toner image is fixed to the sheet.

It is to be noted that the image forming apparatus 100 further includes a toner bottle set 120 on an upper face of the apparatus body. The toner bottle set 120 sets respective color toner bottles 121 (i.e., toner bottles 121Y, 121M, 121C, and 121K) that contains toner to be supplied to the developing device 104 of the image forming unit 101. Further, the image forming apparatus 100 further includes an operation unit 124 that includes a display 122 and a control panel 123.

In addition, a sheet entrance D is provided on the right side of the housing of the image forming apparatus 100 in FIG. 2. A sheet conveyed from the sheet feeding device 200 (FIG. 3) comes in the housing of the image forming apparatus 100 through the sheet entrance D. At the sheet entrance D, a bypass tray opening 125 and a pair of bypass rollers 126 are provided. The sheet is received through the bypass tray opening 125 and then is conveyed by the pair of bypass rollers 126.

Figure 3:
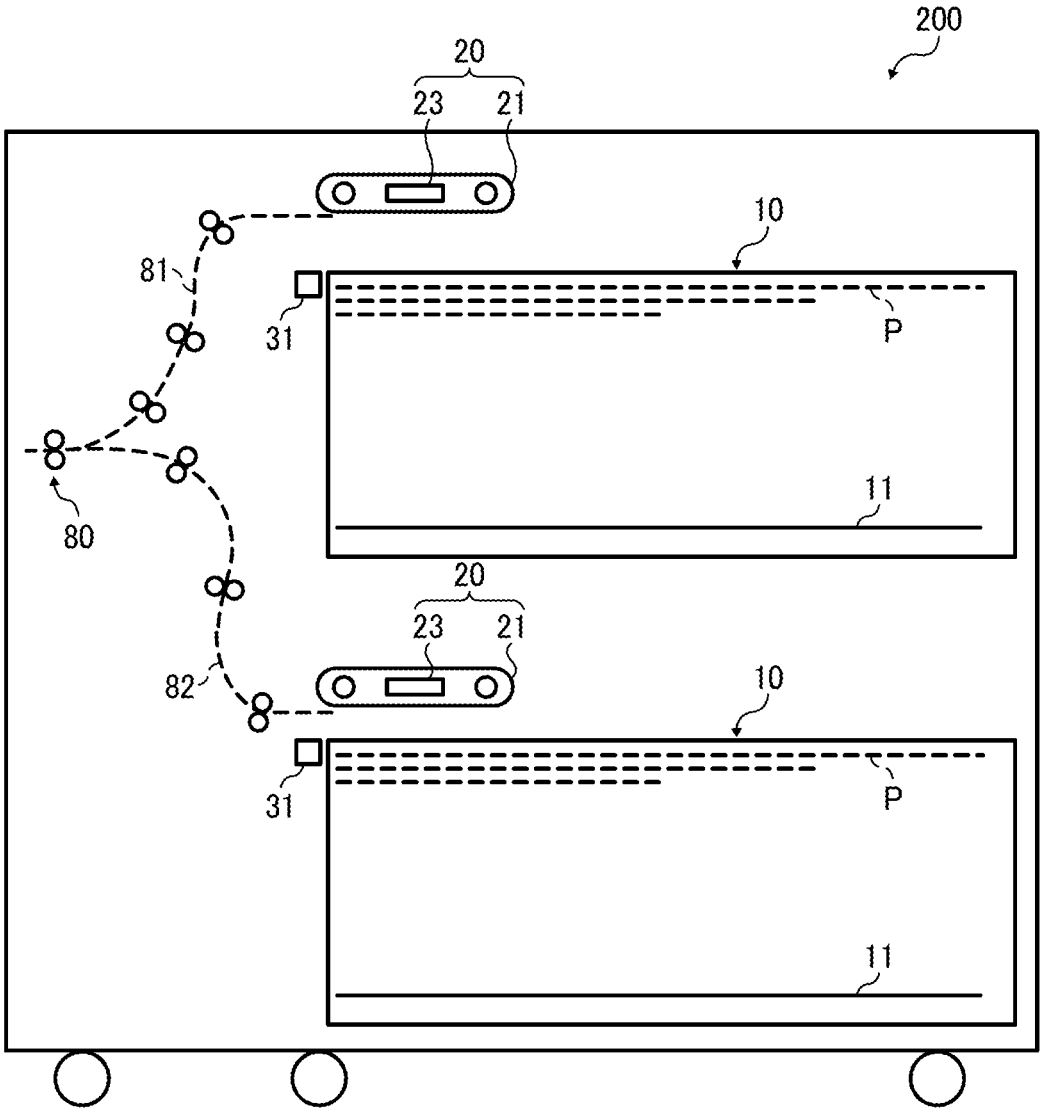
FIG. 3 is a diagram illustrating a schematic configuration of a sheet feeding device according to an embodiment of this disclosure.

FIG. 3 is a diagram illustrating a schematic configuration of the sheet feeding device 200 according to the present embodiment this disclosure. The sheet feeding device 200 is disposed at the side face of the housing of the image forming apparatus 100.

The sheet feeding device 200 includes two sheet trays 10 disposed vertically to each other (i.e., a lower sheet tray 10 and an upper sheet tray 10). Each of the sheet trays 10 includes a sheet loading table 11 that functions as a sheet loader on which a sheet bundle P is loaded. In the present embodiment, each of the sheet trays 10 can contain up to about 2500 sheets therein. A sheet feeding unit 20 is disposed above the corresponding sheet tray 10. The sheet feeding unit 20 separates and feeds a sheet P loaded on the sheet tray 10. The sheet feeding unit 20 includes an attraction belt 21 that functions as a conveying member and an air drawing device 23.

Each of the sheet trays 10 further includes a sheet face detection sensor 31 to detect a floating sheet that is lifted by an air blowing device to control vertical movement of the sheet loading table 11. The sheet face detection sensor 31 includes a first sheet face detection sensor 31*a* and a second sheet face detection sensor 31*b*. Details of the first sheet face detection sensor 31*a* and the second sheet face detection sensor 31*b* are described below.

Each sheet loaded on the lower sheet tray 10 passes through a lower conveying passage 82 to be conveyed by a pair of outlet rollers 80 to an apparatus body of the image forming apparatus 100. Similarly, each sheet loaded on the upper sheet tray 10 passes through an upper conveying passage 81 to be conveyed by the pair of outlet rollers 80 to the apparatus body of the image forming apparatus 100.

Figure 4:
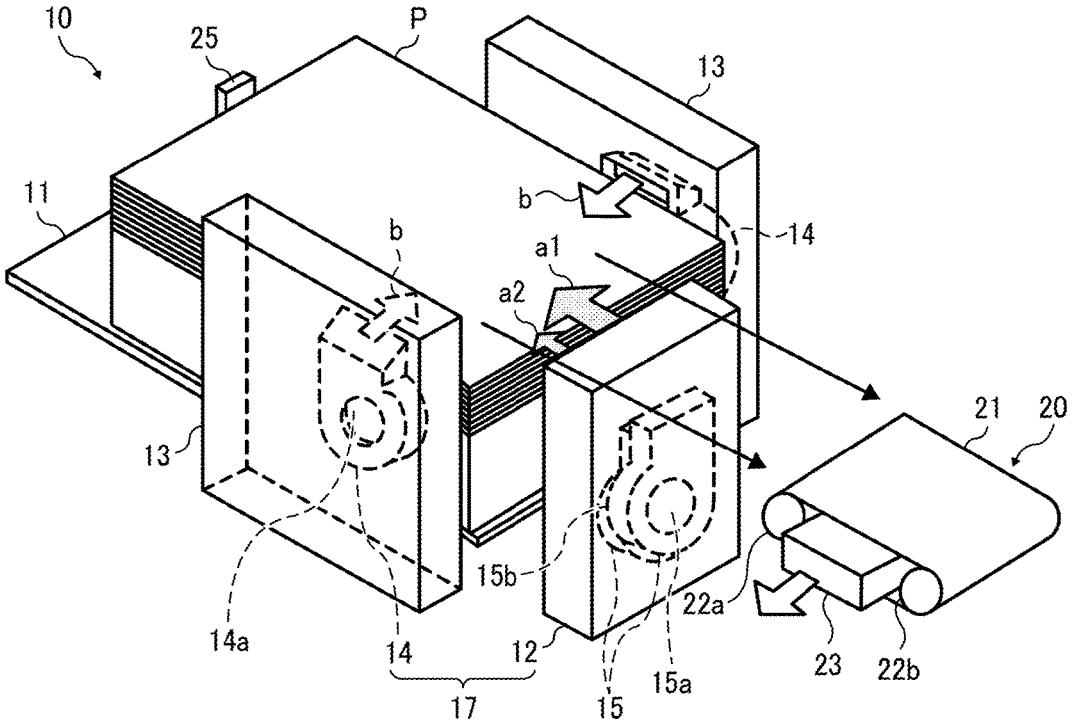
FIG. 4 is a perspective view illustrating a sheet tray included in the sheet feeding device.

FIG. 4 is a perspective view illustrating one of the sheet trays 10 included in the sheet feeding device 200.

The attraction belt 21 of the sheet feeding unit 20 is stretched by two tension rollers 22*a* and 22*b* and includes multiple air drawing openings over an entire region in a circumferential direction thereof. The multiple air drawing openings penetrate through the attraction belt 21 from a front face side to a back face side.

The air drawing device 23 is disposed within an inner loop of the attraction belt 21. The air drawing device 23 is coupled with a drawing fan that intakes air via an air duct that functions as an air flowing passage. As the air drawing device 23 generates a negative pressure in a lower area, the sheet P is attracted to a lower face of the attraction belt 21.

Further, each sheet tray 10 includes an air blowing device 17 that functions as an air blower to blow air to the upper side of the sheet bundle P. The air blowing device 17 includes a front air blowing device 12 and a pair of side air blowing units 14.

The front air blowing device 12 blows air to a leading end of the upper part of the sheet bundle P (i.e., a downstream side end in the sheet feeding direction). The front air blowing device 12 includes a floating nozzle, a separation nozzle, and two front air blowing units 15 including respective air blowing fans 15*a* and 15*b*. The floating nozzle guides air in a direction to float the sheets in the sheet bundle P. The separation nozzle guides air in a direction to separate an uppermost floating sheet and other floating sheet(s). The front air blowing units 15 includes the respective air blowing fans 15*a* and 15*b* to blow air to the floating nozzle from one of the front air blowing units 15 and to the separation nozzle from the other. Air that is blown from the floating nozzle in a direction indicated by arrow a1 in FIG. 4 is referred to as floating air. Air that is blown from the separation nozzle in a direction indicated by arrow a2 in FIG. 4 is referred to as separation air. The floating air and the separation air are discharged from respective portions facing the leading end of the upper part of the sheet bundle P. Consequently, the floating air and the separation air are blown to the leading end of the upper part of the sheet bundle P (i.e., the downstream side end in the sheet feeding direction).

It is to be noted that the front air blowing device 12 includes the above-described two front air blowing units 15 in this configuration. However, the configuration is not limited thereto and the front air blowing device 12 can include a single front air blowing unit 15 or three or more front air blowing units 15.

The pair of side air blowing units 14 are mounted on both sides of a pair of side fences 13, respectively, to blow air in a direction indicated by arrow b to the side face of the upper sheets of the sheet bundle P. Each of the pair of side air blowing units 14 includes a side floating nozzle that flips and separates the sheets of the sheet bundle P and guides air to a direction to lift the sheets P. Air that is blown from the side floating nozzle in the direction indicated by arrow b in FIG. 4 is referred to as side air. The side air is discharged from an air discharging port that is provided at a portion of each of the pair of side fences 13, facing the upper part of the sheet bundle P. Consequently, the floating air is discharged from the air discharging port and is blown to the side face of the upper part of the sheet bundle P. Due to the front air blowing device 12 and the air discharged and blown through the air discharging ports of the pair of side fences 13, the upper sheets of the sheet bundle P are lifted to float.

Further, each sheet tray 10 includes an end fence 25 to align the trailing end of the sheet bundle P loaded on the sheet loading table 11.

Figure 5:
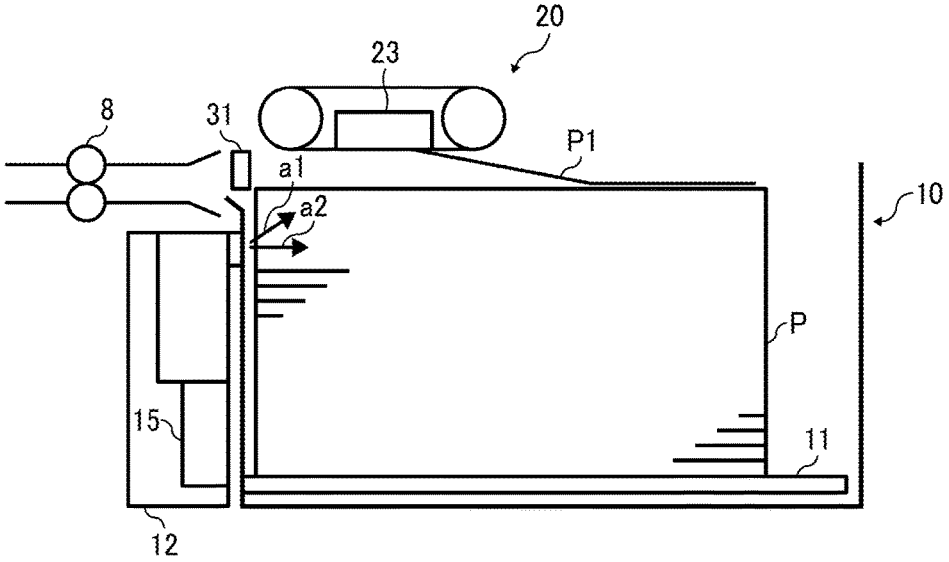
FIG. 5 is a cross sectional view illustrating the sheet tray.

FIG. 5 is a cross sectional view the sheet tray 10 included in the sheet feeding device 200.

In addition, a pair of sheet conveying rollers 8 is disposed downstream from the attraction belt 21 in the sheet conveying direction. The pair of sheet conveying rollers 8 is a downstream sheet conveying member to convey the sheet P that has been conveyed by the attraction belt 21 and reached between two rollers thereof toward a further downstream side in the sheet conveying direction.

Further, as illustrated in FIG. 5, the sheet face detection sensor 31 is disposed in a sheet loading direction.

As described above, the sheet face detection sensor 31 in the present embodiment includes the first detecting sensor 31*a* and the second sheet face detection sensor 31*b*. The sheet face detection sensor 31 is at least one reflective optical sensor that includes at least one light emitting element and a light receiving element.

Figure 6:
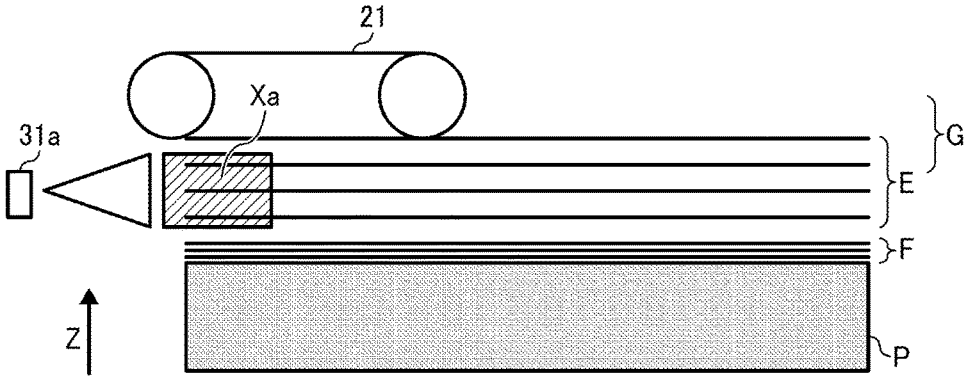
FIG. 6 is a diagram illustrating a sheet detection sensor.

FIG. 6 is a diagram illustrating the sheet face detection sensor 31.

It is to be noted that, as described above, the sheet face detection sensor 31 in the present embodiment includes two sheet face detection sensors, which are the first detecting sensor 31*a* and the second sheet face detection sensor 31*b*. However, the configuration including two sheet face detection sensors is not different from a configuration including a single sheet face detection sensor in principle. Therefore, a description given below is basically the configuration with a single sheet face detection sensor. Specifically, in the present embodiment, a description is given of the configuration with the first detecting sensor 31*a*. However, it is to be noted that the second sheet face detection sensor 31*b* basically has an identical configuration to the first detecting sensor 31*a*, and therefore a detailed configuration and functions are omitted here.

As illustrated in FIG. 6, the first sheet face detection sensor 31*a* detects a detection area Xa. The detection area Xa has a certain height in a Z direction (i.e., in a vertical direction) in FIG. 6, so that multiple sheets of the sheet bundle P are detected. Specifically, the detection area Xa is a light emitting range of the light emitting element of the first sheet face detection sensor 31*a*. When light that is emitted from the light emitting element is reflected on the detection area Xa, the reflected light is collected by a lens, so that the collected light is received by the light receiving element.

Next, a description is given of a detecting method of the sheet detection sensor 31.

A threshold value β1 of the first sheet face detection sensor 31*a* is set to be an output value of the first sheet face detection sensor 31*a* obtained when there are the specified number of floating sheets A (A>1) in the detection area Xa. In addition, when the average of reflectance per sheet in the detection area Xa is γ (avg.), the threshold value β1 is expressed as: γ (avg.)*the specified number of sheets A (A>1).

Further, as illustrated in FIG. 6, the detection area Xa in the present embodiment corresponds to the floating region E. A region in which multiple upper floating sheets exist in the floating region E is referred to as an attraction region G. The sheet feeding unit 20 causes floating sheets to be attracted to the attraction region G. Generally, there are two or three sheets of the upper sheets of the sheet bundle P in the attraction region G. A region in which floating sheets exist below the upper floating sheets in the floating region E is referred to as a semi-floating region F.

As the number of floating sheets in the floating region E decreases, an output value α1 of the first sheet face detection sensor 31*a* drops below the threshold value β1 to lift the sheet loading table 11. Due to this elevation of the sheet loading table 11, the floating sheets in the semi-floating region F, which are the sheets of the sheet bundle P in a lower region below the floating region E, are supplied to the floating region E. As a result, the number of floating sheets in the floating region E increases, the output value α1 of the first sheet face detection sensor 31*a* increases. In the present embodiment, the semi-floating region F extends by 5 mm below the floating region E.

Next, a description is given of a control of a sheet feeding operation according to the present embodiment of this disclosure.

Figure 7:
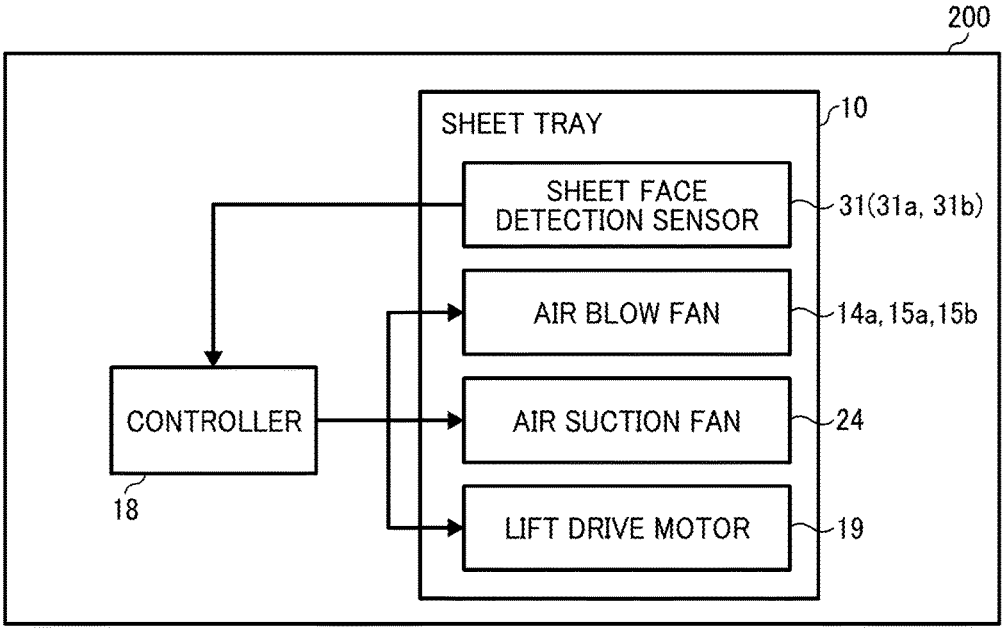
FIG. 7 is a block diagram illustrating a configuration of a control system included in the sheet feeding device according to an embodiment of this disclosure.

FIG. 7 is a block diagram illustrating a configuration of a control system of the sheet feeding device 200 according to an embodiment of this disclosure.

As illustrated in FIG. 7, a controller 18 that functions as a control device of the sheet feeding device 200 is connected to the first sheet face detection sensor 31*a* and the second sheet face detection sensor 31*b* of each sheet tray 10. The controller 18 is further connected to the front air blowing unit 15 of the front air blowing device 12, air blowing fans 14*a* of the pair of side air blowing units 14, and an air drawing fan 24 of the air drawing device 23. The front air blowing unit 15 blows air to the floating nozzle and the separation nozzle of the front air blowing device 12. The air blowing fans 14*a* blow air to the side floating nozzles of the pair of side air blowing units 14. The controller 18 is further connected to an elevation drive motor 19 that functions as a loader elevation device to lift and lower the sheet loading table 11.

Figure 8:
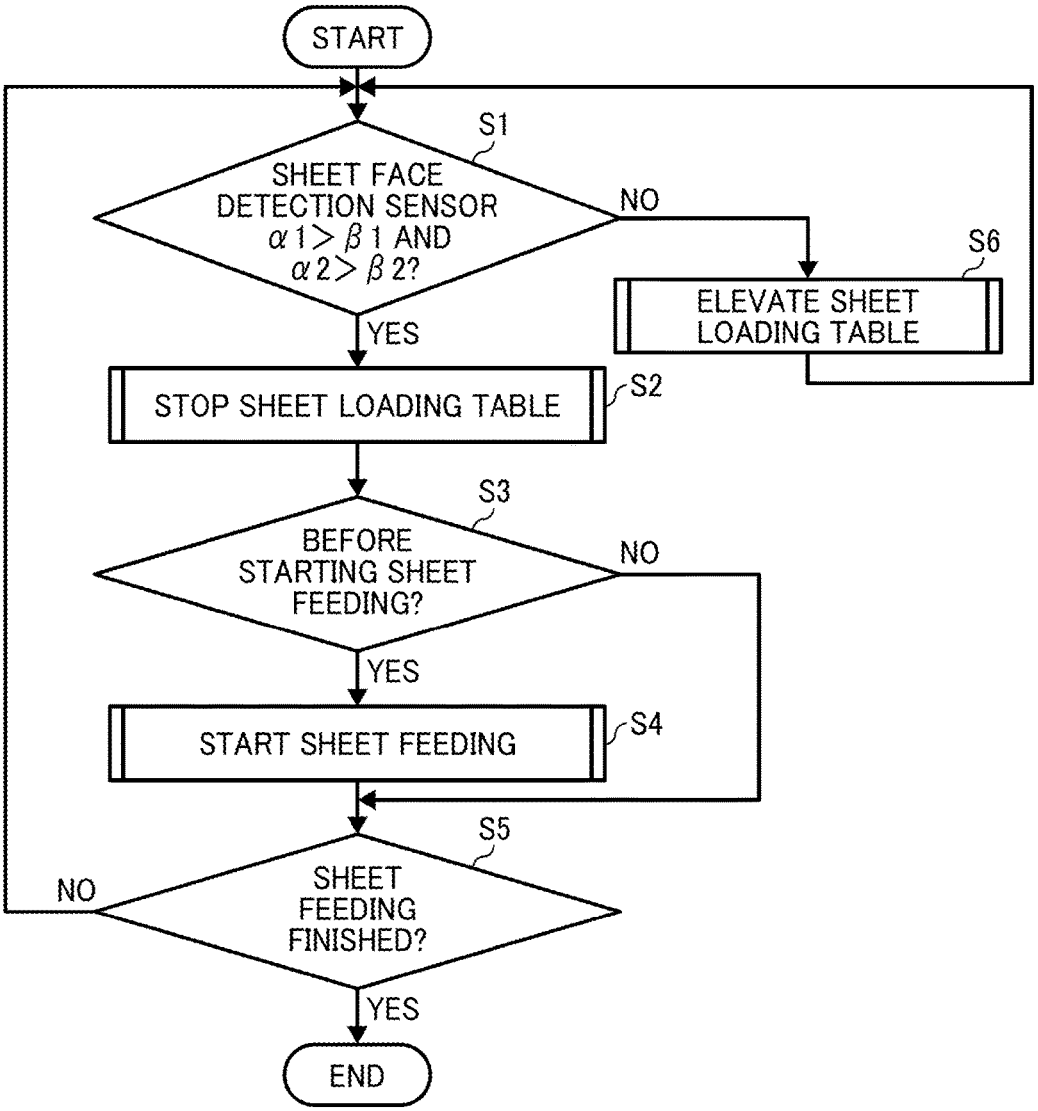
FIG. 8 is a flowchart of a sheet feeding operation performed by the sheet feeding device.

FIG. 8 is a flowchart of the sheet feeding operation performed by the sheet feeding device 200 according to the present embodiment of this disclosure.

The controller 18 determines whether an output value α1 of the first sheet face detection sensor 31*a* is equal to or greater than a threshold value β1 and whether an output value α2 of the second sheet face detection sensor 31*b* is equal to or greater than a threshold value β2, in step S1.

When both the output value α1 of the first sheet face detection sensor 31*a* and the output value α2 of the second sheet face detection sensor 31*b* are not equal to or greater than the threshold value β1 and the threshold value β2, respectively (NO in step S1), the controller 18 drives the elevation drive motor 19 to elevate the sheet loading table 11, in step S6. On elevation of the sheet loading table 11, the upper part of the sheet bundle P comes in the detection area Xa of the first sheet face detection sensor 31*a*. The light emitted from the light emitting element of the first sheet face detection sensor 31*a* is reflected on the upper part of the sheet bundle P and then received by the light receiving element. As a result, the output value (i.e., the output values α1 and α2) of the sheet face detection sensor 31 (i.e., the first sheet face detection sensor 31*a* and the second sheet face detection sensor 31*b*) increases.

When the output values α1 and α2 become equal to or greater than the threshold values β1 and β2, respectively (YES in step S1), the controller 18 stops lifting the sheet loading table 11, in step S2. Accordingly, the upper face of the sheet bundle P is located at a sheet feeding position.

Next, the controller 18 determines whether the sheet feeding operation has not started, in step S3. When the sheet feeding operation has not yet started (YES in step S3), the controller 18 starts the sheet feeding operation, in step S4. Specifically, the controller 18 starts driving each of the pair of side air blowing units 14 (each of the air blowing fans 14*a*) and the front air blowing device 12 (the air blowing fans 15*a* and 15*b* of the front air blowing units 15) with movement of the attraction belt 21 being stopped. Accordingly, the floating air is discharged from the floating nozzle of the front air blowing device 12 and the separation air is discharged from the separation nozzle of the front air blowing device 12. Therefore, air is blown to a front end part of the upper part of the sheet bundle P. In addition, air is discharged from the air discharging port of the side duct of the pair of side fences 13, so that the air is blown to the side end part of the upper part of the sheet bundle P. Accordingly, sheets on the upper part of the sheet bundle P are lifted and floated.

At the same time, the controller 18 starts driving the air drawing fan 24 to start air drawing by the air drawing device 23. By so doing, a floating uppermost sheet P1 is attracted to the attraction belt 21. Consequently, after a predetermined period of time has elapsed from the start of air drawing by the air drawing device 23, the controller 18 starts driving the attraction belt 21 while the air drawing fan 24 is in operation. By so doing, the surface of the attraction belt 21 moves, so that the uppermost sheet P1 that is attracted to the lower face of the attraction belt 21 is conveyed to the downstream side of the sheet conveying direction, and reaches the pair of sheet conveying rollers 8. Thereafter, as the pair of sheet conveying rollers 8 is rotated, the uppermost sheet P1 is conveyed to the image forming apparatus 100.

Then, the controller 18 determines whether the sheet feeding operation is finished, in step S5. When the sheet feeding operation is completed (YES in step S5), the procedure ends. When the sheet feeding operation continues (NO in step S5), the procedure is returned to step S1 to continuously monitor to determine whether the output value α1 of the first sheet face detection sensor 31*a* is equal to or greater than the threshold value β1 and whether the output value α2 of the second sheet face detection sensor 31*b* is equal to or greater than a threshold value β2.

It is to be noted that an amount of elevation of the sheet loading table 11, control for a certain period of time after the floating air is ON (active), and control at a timing to make the floating air OFF (inactive) are described below.

Figure 9A:
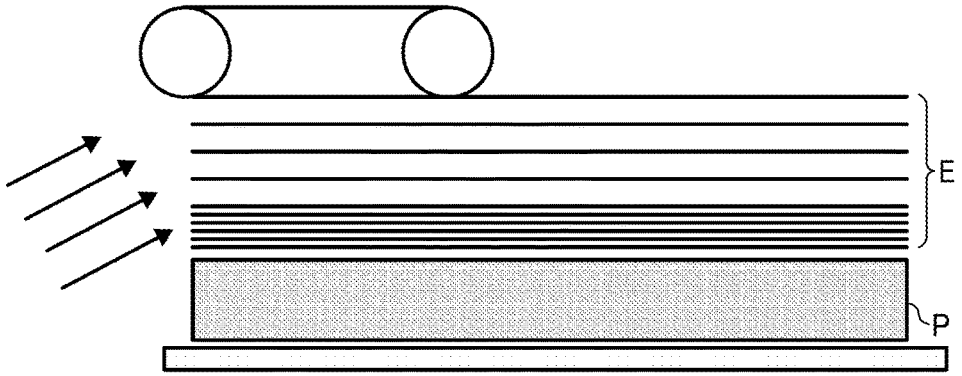
FIG. 9A is a diagram illustrating a sheet feeding unit in a normal sheet feeding condition.
Figure 9B:
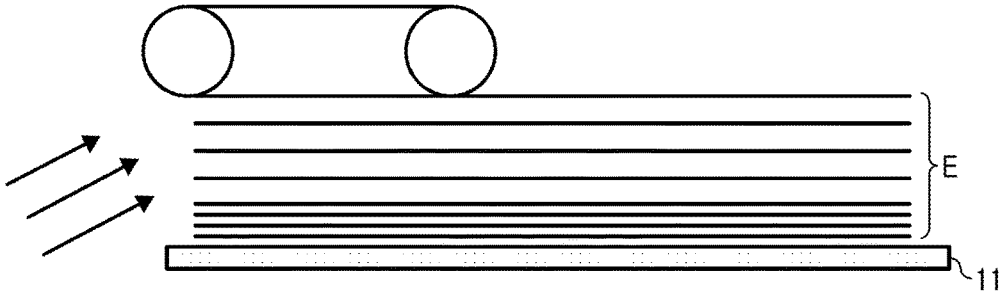
FIG. 9B is a diagram illustrating a mechanism of occurrence of no sheet feeding or a failure of feeding sheets when the number of sheets when the number of sheets in the sheet tray approaches zero.

FIG. 9A is a diagram illustrating the sheet feeding unit 20 in a normal sheet feeding condition. FIG. 9B is a diagram illustrating a mechanism of occurrence of no sheet feeding or a failure of feeding sheets when the number of sheets when the number of sheets in the sheet tray approaches zero.

As illustrated in FIG. 9A, when the sheet bundle P having sufficient number of sheets is loaded on the sheet loading table 11, which is the normal sheet feeding condition, as the sheet conveying operation continues following the flowchart of FIG. 7, the number of sheets of the sheet bundle P on the sheet loading table 11 decreases. Then, as illustrated in FIG. 9B, the sheet loading table 11 stays within an air blowing region of the floating air along with the elevation of the sheet loading table 11. Hereinafter, the condition is referred to as a nearly zero sheet state. When the number of sheets in the sheet tray 10 approaches zero (i.e., in the nearly zero sheet state), the number of sheets in the sheet bundle P becomes short. In addition, since the sheet loading table 11 stays within the floating air blowing region, the amount of floating air to be blown to the side face of the sheet bundle P. Accordingly, when compared with the normal sheet feeding state, the number of sheets in the semi-floating region F decreases.

Specifically, for example, a comparative sheet feeding device detects the density of floating sheets in the sheet floating region (full or empty of the floating sheets) according to the output value of the sheet detection sensor. In other words, whether the number of floating sheets is full (dense) or nearly empty (sparse) in the sheet floating region.

However, the timings of occurrence of the small number of floating sheets in the sheet floating region can occur depending on sheet type and operating environment. Therefore, it is unlikely to prevent occurrence of no sheet feeding because of late switching of the amount of elevation of the sheet loader when a decrease in the number of floating sheets occurs in the sheet floating region.

It is to be noted that the sheet face detection sensor in the comparative sheet feeding device has a length of 3 mm in a detection area in the Z direction.

As the number of floating sheets in the semi-floating region F decreases, the number of sheets to be supplied to the floating region E per elevation of the sheet loading table 11 also decreases. Therefore, the output value $\alpha 1$ of the first sheet face detection sensor 31*a* frequently becomes equal to or smaller than the threshold value $\beta 1$. Due to this inconvenience, the amount of elevation in the normal sheet feeding operation eventually cannot fully elevate the sheet loading table 11. Consequently, a small number of sheets or no sheet stays in the attraction region G. As a result, no sheet feeding occurs.

In order to overcome the above-described problem in the nearly zero sheet state, the sheet feeding device 200 in the present embodiment includes the sheet face detection sensor 31 having the following configuration.

Figure 10:
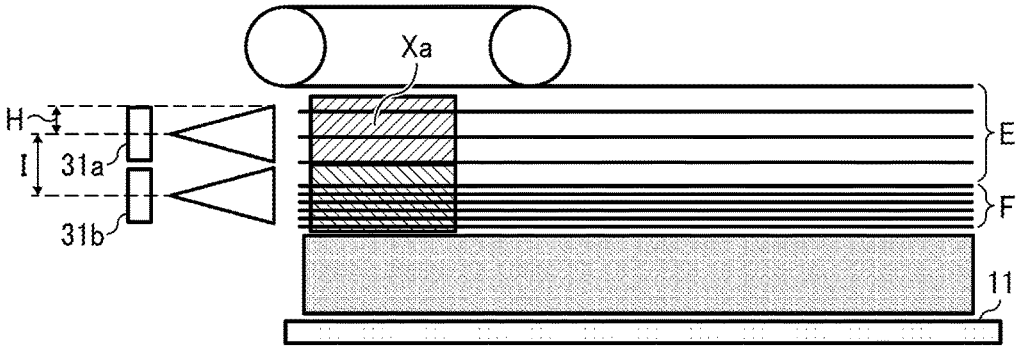
FIG. 10 is a diagram illustrating a configuration of a sheet face detection sensor according to an embodiment of this disclosure.

FIG. 10 is a diagram illustrating a configuration of the sheet face detection sensor 31 according to an embodiment of this disclosure.

In the present embodiment, the sheet face detection sensor 31 includes the first sheet face detection sensor 31*a* that functions as a first sheet face detector and the second sheet face detection sensor 31*b* that functions as a second sheet face detector. The controller 18 according to the present embodiment controls a lifting operation and an amount of elevation of the sheet loading table 11 based on whether or not the output value $\alpha 1$ of the first sheet face detection sensor 31*a* and the output value $\alpha 2$ of the second sheet face detection sensor 31*b* are equal to or smaller than the threshold value $\beta 1$ and the threshold value $\beta 2$, respectively.

Next, a description is given of control of the lifting operation of the sheet loading table 11 according to the present embodiment of this disclosure.

As indicated in Table 1 below, there are four patterns (Patterns 1, 2, 3, and 4) of combination of the output value $\alpha 1$ of the first sheet face detection sensor 31*a* and the output value $\alpha 2$ of the second sheet face detection sensor 31*b*.

TABLE 1

| Output Value | | Pattern 1 | Pattern 2 | Pattern 3 | Pattern 4 |
|---|---|---|---|---|---|
| First Sheet Face Detection Sensor 31a | $\alpha 1$ | $\leq\beta 1$ | $\leq\beta 1$ | $>\beta 1$ | $>\beta 1$ |
| Second Sheet Face Detection Sensor 31b | $\alpha 2$ | $\leq\beta 2$ | $>\beta 2$ | $>\beta 2$ | $\leq\beta 2$ |
| Bottom Plate | | X2 mm UP | X1 mm UP | Stop | X3 mm UP |

Pattern 1 represents a case in which both the output values $\alpha 1$ and $\alpha 2$ are equal to or smaller than the threshold values $\beta 1$ and $\beta 2$, respectively. In this case, the floating sheets are sparse in both the sheet floating region and the semi-floating region. It is highly likely that no sheet feeding occurs. Therefore, the sheet loading table 11 is lifted by the amount of elevation X2 [mm], which is greater than the regular amount of elevation X1 [mm], so that sheets are supplied to the sheet floating region promptly.

Pattern 2 represents a case in which the output value $\alpha 1$ is equal to or smaller than the threshold value $\beta 1$ and the output value $\alpha 2$ is greater than the threshold value $\beta 2$. In this case, the floating sheets are sparse in the sheet floating region while the number of floating sheets in the semi-floating region is equal to or greater than the threshold value. Since the sheets in the semi-floating region can be supplied to the sheet floating region, in Pattern 2, the sheet loading table 11 is lifted by the amount of elevation X1 [mm], which is smaller than the amount of elevation X2 [mm] ($X1<X2$).

It is to be noted that the regular lifting operation of the sheet loading table 11 is controlled based on Pattern 2. Accordingly, the amount of elevation X1 of Pattern 2 is hereinafter referred to as a regular amount of elevation X1

Pattern 3 represents a case in which both the output values $\alpha 1$ and $\alpha 2$ are greater than the threshold values $\beta 1$ and $\beta 2$, respectively. In this case, the number of floating sheets in both the sheet floating region and the semi-floating region are equal to or greater than the threshold values. Therefore, the lifting operation of the sheet loading table 11 is not performed.

Pattern 4 represents a case in which the output value $\alpha 1$ is greater than the threshold value $\beta 1$ and the output value $\alpha 2$ is equal to or smaller than the threshold value $\beta 2$. In this case, the number of floating sheets in the sheet floating region is equal to or greater than the threshold value while the floating sheets are sparse in the semi-floating region. In this state, even if the sheet loading table 11 is lifted when the floating sheets are sparse in the sheet floating region, the number of floating sheets in the semi-floating region. Therefore, the floating sheets are not sufficiently supplied to the sheet floating region, and it is unlikely that the sheets can be fully supplied to the attraction region. Therefore, in Pattern 4, the sheet loading table 11 is lifted by the regular amount of elevation X1 [mm], which is smaller than an amount of elevation X3 [mm] ($X3<X1$), so that the density of the floating sheets is increased in the semi-floating region.

As described above, by setting the amount of elevation X3 [mm] of the sheet loading table 11 in Pattern 4 to be equal to or smaller than the regular amount of elevation X1, the amount of elevation of the sheet loading table 11 can be controlled finely, the inconvenience described below can be controlled. That is, in the case of Pattern 4, the floating sheets are dense in the sheet floating region. In such a case, if the sheet loading table 11 is lifted by the regular amount of elevation X1 [mm], the floating sheets in the semi-floating region becomes denser. Due to this increase in density of the floating sheets in the semi-floating region, it is likely that the floating sheets in the sheet floating region also becomes dense. Such an increase in density of the floating sheets in the sheet floating region is likely to cause multi-feeding. By finely controlling the amount of elevation of the sheet loading table 11, as described in Pattern 4, such an adverse effect to the sheet floating region can be reduced to the lowest possible level. Consequently, multi-feeding that may occur due to congestion of the floating sheets in the sheet floating region can be restrained.

In the sheet feeding device 200 according to the present embodiment, the regular lifting operation of the sheet loading table 11 is controlled based on Patterns 2 and 3. Then, in a case in which the number of floating sheets in the sheet floating region is equal to or greater than the threshold value and the floating sheets are sparse in the semi-floating region, the sheet loading table 11 is lifted by the control of Pattern 4, that is, by the amount of elevation X3 [mm] that is smaller than the regular amount of elevation X1 [mm]. This lifting operation of the sheet loading table 11 can prevent no sheet feeding due to the decrease in the floating sheets in the sheet floating region that can be caused by the decrease in the floating sheets in the semi-floating region.

Further, even when the control of Pattern 4 cannot float the sufficient number of floating sheets, the floating sheets become sparse in both the sheet floating region and the semi-floating region. At this time, the control of Pattern 1 is performed in the present embodiment, which can prevent no sheet feeding due to the decrease in the floating sheets in the sheet floating region when the number of sheets in the sheet tray 10 approaches zero, in two stages.

In addition, as illustrated in FIG. 10, the sheet feeding device 200 according to the present embodiment includes two sheet face detection sensors, which are the first detecting sensor 31*a* and the second sheet face detection sensor 31*b* disposed as described below. Specifically, the first sheet face detection sensor 31*a* is disposed approximately 12 [mm] below the lowest face of the attraction belt 21, as indicated by arrow H in FIG. 10. Further, the second sheet face detection sensor 31*b* is disposed approximately 6 [mm] below the first sheet face detection sensor 31*a*, as indicated by arrow I in FIG. 10. With this configuration, both the first sheet face detection sensor 31*a* and the second sheet face detection sensor 31*b* monitor a floating state of sheets in the sheet floating region E and the semi-floating region F, respectively.

Further, the lifting operation of the sheet loading table 11 may be switched by associating the condition of the lifting operation with the condition of the floating air. In the sheet feeding device 200 according to the present embodiment, the floating air is switched between the active state (ON) and the inactive state (OFF) according to the condition of the lifting operation of the sheet loading table 11.

As indicated in Tables 2A, 2B, and 2C below, the following control patterns of the sheet feeding device 200 are applied when the lifting operation of the sheet loading table 11 is switched by associating the conditions of the lifting operation with the conditions of the floating air. Table 2A shows a case in which the floating air is turned to active (ON). Table 2B shows a case in which the condition of the floating air after a time T[s] has elapsed from the condition of Table 2A. Table 2C shows respective controls in Patterns 1, 2, 3, and 4 when the floating air is turned to inactive (OFF) from the condition of Table 2B.

TABLE 2A

| Output Value | | Pattern 1 | Pattern 2 | Pattern 3 | Pattern 4 |
|---|---|---|---|---|---|
| First Sheet Face Detection Sensor 31a | α1 | ≤β1 | ≤β1 | >β1 | >β1 |
| Second Sheet Face Detection Sensor 31b | α2 | ≤β2 | >β2 | >β2 | ≤β2 |
| Bottom Plate | | X2 mm UP | Stop | Stop | X3 mm UP |

TABLE 2B

| Output Value | | Pattern 1 | Pattern 2 | Pattern 3 | Pattern 4 |
|---|---|---|---|---|---|
| First Sheet Face Detection Sensor 31a | α1 | ≤β1 | ≤β1 | >β1 | >β1 |
| Second Sheet Face Detection Sensor 31b | α2 | ≤β2 | >β2 | >β2 | ≤β2 |
| Bottom Plate | | X2 mm UP | X1 mm UP | Stop | X3 mm UP |

TABLE 2C

| Output Value | | Pattern 1 | Pattern 2 | Pattern 3 | Pattern 4 |
|---|---|---|---|---|---|
| First Sheet Face Detection Sensor 31a | α1 | ≤β1 | ≤β1 | >β1 | >β1 |
| Second Sheet Face Detection Sensor 31b | α2 | ≤β2 | >β2 | >β2 | ≤β2 |
| Bottom Plate | | X2 mm UP | Stop | Stop | X3 mm UP |

As indicated in Patterns 2 and 3 in Table 2C, when the floating air is turned to inactive (OFF), the lifting operation of the sheet loading table 11 stops at the moment the output value α2 of the second sheet face detection sensor 31*b* exceeds the threshold value β2. For example, the sheet loading table 11 is lifted to elevate the sheet bundle P to a position where the output value α1 of the first sheet face detection sensor 31*a* becomes equal to or greater than the threshold value β1. Then, when the floating air is turned to be active (ON) to float the sheets, it is likely that there is the excess number of floating sheets in the sheet floating region. Therefore, as indicated in Table 2C, the elevation of the sheet loading table 11 is stopped at the moment the output value α2 of the second sheet face detection sensor 31*b* exceeds the threshold value β2. This control can prevent the excess number of floating sheets in the sheet floating region when the floating air is turned to be active (ON).

Further, the sheet floating condition does not become stable during a period after the floating air is turned to be active (ON) and before a predetermined period of time T[s] has elapsed. Therefore, as indicated in Table 2A, a matrix having the same condition as when the floating air is turned to be in active (OFF) is applied. It is to be noted that, in the present embodiment, the predetermined period of time T[s] from the activation (ON) of the floating air is set to 5 seconds.

In addition, the amounts of elevation of the sheet loading table 11 in each of Patterns 1 through 4 are set as follows: X1=1 [mm], X2=3 [mm], and X3=0.5 [mm].

The configurations according to the above-descried embodiments are not limited thereto. This disclosure can achieve the following aspects effectively.

Aspect A.

In Aspect A, a sheet feeder (for example, the sheet feeding device 200) includes a sheet loader (for example, the sheet loading table 11), an air blower (for example, the air blowing device 17), a loader elevation device (for example, the elevation drive motor 19), a reflective optical detector (for example, the sheet face detection sensor 31), and a controller (for example, the controller 18). A sheet bundle (for example, the sheet bundle P) is loaded on the sheet loader. The air blower is configured to blow air to the sheet bundle loaded on the sheet loader and float upper sheets of the sheet bundle. The loader elevation device is configured to lift and lower the sheet loader. The reflective optical detector includes a first reflective optical detector (for example, the first sheet face detection sensor 31*a*) and a second reflective optical detector (for example, the second sheet face detection sensor 31*b*). The first reflective optical detector is configured to detect the upper sheets floated by the air blower. The second reflective optical detector is configured to detect multiple floating sheets located below the floating sheets detected by the first reflective optical detector. The controller is configured to control an operation of the loader elevation device based on a combination of an output value (for example, the output value $\alpha 1$) of the first reflective optical detector and an output value (for example, the output value $\alpha 2$) of the second reflective optical detector.

When a detection area of a known reflective optical sensor is a floating region E where sheets float and another area below the floating region E is a semi-floating region F where different sheets float, as the number of sheets in the floating region E decreases, the output value $\alpha$ of the reflective optical sensor becomes equal to or smaller than a threshold value $\beta$. Accordingly, the sheet loader elevates. Due to this elevation of the sheet loader, the floating sheets in the semi-floating region F, which are the sheets of the sheet bundle P in the lower region below the floating region E, are supplied to the floating region E. As a result, the number of floating sheets in the floating region E increases, the output value $\alpha$ of the first reflective optical detector increases. Accordingly, the output value $\alpha$ approaches threshold value $\beta$, which is a target value of the output value $\alpha$.

However, the following inconvenience occur, for example, as the number of sheets of the sheet bundle P loaded on the sheet loader decreases and approaches zero (a nearly zero sheet state) and the sheet loader stays within an air blowing region of floating air along with elevation of the sheet loader. Specifically, when the number of sheets in the sheet tray approaches zero (i.e., in the nearly zero sheet state), the number of sheets in the sheet bundle P becomes short. In addition, since the sheet loader stays within the floating air blowing region, the amount of floating air to be blown to the side face of the sheet bundle P decreases. Accordingly, when compared with the normal sheet feeding state, the number of sheets in the semi-floating region F decreases. As the number of floating sheets in the semi-floating region F decreases, the number of sheets to be supplied to the sheet floating region E per elevation of the sheet loader also decreases and becomes smaller than the number of sheets to be supplied in a regular state in which the sufficient number of floating sheets is floating in the semi-floating region F. Therefore, the output value $\alpha$ of the reflective optical detector frequently becomes equal to or smaller than the threshold value $\beta$. Due to this inconvenience, the amount of elevation in the normal sheet feeding operation eventually cannot fully elevate the sheet loader. Consequently, a small number of sheets or no sheet stays in the attraction region. As a result, no sheet feeding occurs.

In Aspect A, as described in the embodiments above, the reflective optical sensor includes the first reflective optical detector that detects the floating sheets in the sheet floating region E and the second reflective optical sensor that detects the floating sheets in the semi-floating region F. Accordingly, the following operations can be performed. Specifically, the density of the floating sheets in the sheet floating region E and the density of the floating sheets in the semi-floating region F can be detected. Therefore, whether or not the sheet loader is to be lifted can be detected not only in the sheet floating region E but also in the semi-floating region F. Further, in Aspect A, the controller controls the loader elevation device to perform the lifting operation of the sheet loader based on a combination of the output value (i.e., the output value $\alpha 1$) of the first reflective optical detector and the output value (i.e., the output value $\alpha 2$) of the second reflective optical detector. Accordingly, the lifting operation of the sheet loader can be controlled such that the density of the floating sheets in the semi-floating region F falls on a specified value, which can prevent a decrease in the floating sheets in the sheet floating region E that occurs when the floating sheets are sparse in the semi-floating region F. Consequently, no sheet feeding due to the decrease in the floating sheets in the sheet floating region E can be restrained.

Aspect B.

In Aspect A, the controller (for example, the controller 18) controls both whether the loader elevation device (for example, the elevation drive motor 19) performs a lifting operation of the sheet loader (for example, the sheet loading table 11) and whether an amount of elevation of the sheet loader is changed, based on the combination of the output value (for example, the output value $\alpha 1$) of the first reflective optical detector (for example, the first sheet face detection sensor 31*a*) and the output value (for example, the output value $\alpha 2$) of the second reflective optical detector (for example, the second sheet face detection sensor 31*b*).

Aspect C.

In the sheet feeder (for example, the sheet feeding device 200) according to Aspect A or Aspect B, the second reflective optical detector (for example, the second sheet face detection sensor 31*b*) is disposed at a position shifted form the first reflective optical detector (for example, the first sheet face detection sensor 31*a*) by a predetermined amount in a vertical direction of the sheet bundle (for example, the sheet bundle P).

Aspect D.

In the sheet feeder (for example, the sheet feeding device 200) according to any one of Aspect A through Aspect C, the amount of elevation (for example, the amount of elevation X2) of the sheet loader (for example, the sheet loading table 11) obtained when both the output value (for example, the output value $\alpha 1$) of the first reflective optical detector (for example, the first sheet face detection sensor 31*a*) and the output value (for example, the output value $\alpha 2$) of the second reflective optical detector (for example, the second sheet face detection sensor 31*b*) become equal to or smaller than a threshold value (for example, the threshold value $\beta 1$) of the first reflective optical detector and a threshold value (for example, threshold value $\beta 2$) of the second reflective optical detector, is greater than the amount of elevation (for example, the amount of elevation X1) of the sheet loader obtained when the output value of the first reflective optical detector becomes equal to or smaller than the threshold value of the first reflective optical detector.

When both the output values $\alpha 1$ and $\alpha 2$ are smaller than the threshold values $\beta 1$ and $\beta 2$, respectively, the floating sheets are sparse in both the sheet floating region and the semi-floating region. It is highly likely that no sheet feeding occurs.

In Aspect D, as described in the embodiments above, the sheet loader is lifted by the amount of elevation X2 [mm], which is greater than the regular amount of elevation X1 [mm], so that sheets can be supplied to the sheet floating region promptly.

Aspect E.

In the sheet feeder (for example, the sheet feeding device 200) according to any one of Aspect A through Aspect D, the amount of elevation (for example, the amount of elevation X3) of the sheet loader obtained when the output value (for example, the output value α2) of the second reflective optical detector (for example, the second sheet face detection sensor 31*b*) becomes equal to or smaller than the threshold value (for example, threshold value β2) of the second reflective optical detector is smaller than the amount of elevation (for example, the amount of elevation X1) of the sheet loader obtained when the output value (for example, the output value α1) of the first reflective optical detector (for example, the first sheet face detection sensor 31*a*) becomes equal to or smaller than the threshold value (for example, threshold value β2) of the first reflective optical detector.

When the output value α of the second reflective optical detector becomes equal to or smaller than the threshold value of the second reflective optical detector, the floating sheets are dense in the sheet floating region. In this case, if the sheet loader is lifted by the regular amount of elevation X1 [mm], the floating sheets in the semi-floating region become dense. Therefore, it is likely that the floating sheets in the sheet floating region also become dense. If the density of the floating sheets in the sheet floating region becomes congested, it is likely that multi-feeding occurs.

In Aspect E, as described in the embodiments above, since the sheet loader is lifted by the amount of elevation X3 [mm], which is smaller than the regular amount of elevation X1 [mm], the amount of elevation of the sheet loader can be controlled finely. By finely controlling the amount of elevation of the sheet loader, the adverse effect to the sheet floating region as described above can be reduced to the lowest possible level. Consequently, multi-feeding that may occur due to congestion of the floating sheets in the sheet floating region can be restrained.

Aspect F.

In the sheet feeder (for example, the sheet feeding device 200) according to any one of Aspect A through Aspect E, the threshold value (for example, threshold value β2) of the output value (for example, the output value α2) of the second reflective optical detector (for example, the second sheet face detection sensor 31*b*) is greater than the threshold value (for example, threshold value β1) of the output value (for example, the output value α1) of the first reflective optical detector (for example, the first sheet face detection sensor 31*a*).

Aspect G.

In the sheet feeder (for example, the sheet feeding device 200) according to any one of Aspect A through Aspect F, the lifting operation of the sheet loader (for example, the sheet loading table 11) by the loader elevation device (for example, the elevation drive motor 19) and the change of the amount of elevation (for example, the amounts of elevation X1, X2, and X3) of the sheet loader are changed according to a state of operation of the air blower (for example, the air blowing device 17).

For example, when the floating air is turned to inactive (OFF), the sheet loader is lifted to elevate the sheet bundle (for example, the sheet bundle P) to a position where the output value (for example, the output value α1) of the first reflective optical detector (for example, the first sheet face detection sensor 31*a*) becomes equal to or greater than the threshold value (for example, the threshold value β1). Then, when the floating air is turned to be active (ON) to float the sheets, it is likely that there is the excess number of floating sheets in the sheet floating region.

In Aspect G, as described in the embodiments above, the lifting operation of the sheet loader can be controlled to stop at the moment the output value of the second reflective optical detector exceeds the threshold value. Therefore, this control can prevent the excess number of floating sheets when the floating air is turned to be active (ON) to float the sheets.

Aspect H.

In Aspect H, an image forming apparatus (for example, the image forming apparatus 100) includes an image forming device (for example, the image forming units 101) to form an image on a surface of a sheet, and the sheet feeder (for example, the sheet feeding device 200) according to any one of Aspect A through Aspect G to feed the sheet to the image forming device.

With this configuration, the image forming apparatus restrains sheet feed failure and prevents occurrence of paper jam.

Aspect I.

In Aspect I, an image forming system (for example, the image forming system 1) includes an image forming apparatus (for example, the image forming apparatus 100) including an image forming device (for example, the image forming units 101) to form an image on a surface of a sheet, and the sheet feeder (for example, the sheet feeding device 200) according to any one of Aspect A through Aspect G to feed the sheet to the image forming device.

With this configuration, the image forming system restrains sheet feed failure and prevents occurrence of paper jam.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising:

a sheet loader on which a sheet bundle is loaded;

an air blower configured to blow air to the sheet bundle loaded on the sheet loader and float upper sheets of the sheet bundle;

a loader elevation device configured to lift and lower the sheet loader;

a reflective optical detector including a first reflective optical detector configured to detect the upper sheets floated by the air blower, and a second reflective optical detector configured to detect multiple floating sheets located below the floating sheets detected by the first reflective optical detector; and a controller configured to control the loader elevation device to perform a lifting operation of the sheet loader based on a combination of an output value of the first reflective optical detector and an output value of the second reflective optical detector.

2. The sheet feeder according to claim 1, wherein the controller controls both whether the loader elevation device performs a lifting operation of the sheet loader and whether an amount of elevation of the sheet loader is changed, based on the combination of the output value of the first reflective optical detector and the output value of the second reflective optical detector.

3. The sheet feeder according to claim 2, wherein the second reflective optical detector is disposed at a position shifted form the first reflective optical detector by a predetermined amount in a vertical direction of the sheet bundle.

4. The sheet feeder according to claim 3, wherein the amount of elevation of the sheet loader obtained when both the output value of the first reflective optical detector and the output value of the second reflective optical detector become equal to or smaller than a threshold value of the first reflective optical detector and a threshold value of the second reflective optical detector, is greater than the amount of elevation of the sheet loader obtained when the output value of the first reflective optical detector becomes equal to or smaller than the threshold value of the first reflective optical detector.

5. The sheet feeder according to claim 4, wherein the amount of elevation of the sheet loader obtained when the output value of the second reflective optical detector becomes equal to or smaller than the threshold value of the second reflective optical detector is smaller than the amount of elevation of the sheet loader obtained when the output value of the first reflective optical detector becomes equal to or smaller than the threshold value of the first reflective optical detector.

6. The sheet feeder according to claim 5, wherein the threshold value of the output value of the second reflective optical detector is greater than the threshold value of the output value of the first reflective optical detector.

7. The sheet feeder according to claim 6, wherein the lifting operation of the sheet loader by the loader elevation device and the change of the amount of elevation of the sheet loader are changed according to a state of operation of the air blower.

8. The sheet feeder according to claim 1, wherein the second reflective optical detector is disposed at a position shifted form the first reflective optical detector by a predetermined amount in a vertical direction of the sheet bundle.

9. The sheet feeder according to claim 8, wherein an amount of elevation of the sheet loader obtained when both the output value of the first reflective optical detector and the output value of the second reflective optical detector become equal to or smaller than a threshold value of the first reflective optical detector and a threshold value of the second reflective optical detector, is greater than an amount of elevation of the sheet loader obtained when the output value of the first reflective optical detector becomes equal to or smaller than the threshold value of the first reflective optical detector.

10. The sheet feeder according to claim 9, wherein the amount of elevation of the sheet loader obtained when the output value of the second reflective optical detector becomes equal to or smaller than the threshold value of the second reflective optical detector is smaller than the amount of elevation of the sheet loader obtained when the output value of the first reflective optical detector becomes equal to or smaller than the threshold value of the first reflective optical detector.

11. The sheet feeder according to claim 10, wherein the threshold value of the output value of the second reflective optical detector is greater than the threshold value of the output value of the first reflective optical detector.

12. The sheet feeder according to claim 1, wherein an amount of elevation of the sheet loader obtained when both the output value of the first reflective optical detector and the output value of the second reflective optical detector become equal to or smaller than a threshold value of the first reflective optical detector and a threshold value of the second reflective optical detector, is greater than an amount of elevation of the sheet loader obtained when the output value of the first reflective optical detector becomes equal to or smaller than the threshold value of the first reflective optical detector.

13. The sheet feeder according to claim 12, wherein the amount of elevation of the sheet loader obtained when the output value of the second reflective optical detector becomes equal to or smaller than the threshold value of the second reflective optical detector is smaller than the amount of elevation of the sheet loader obtained when the output value of the first reflective optical detector becomes equal to or smaller than the threshold value of the first reflective optical detector.

14. The sheet feeder according to claim 13, wherein the threshold value of the output value of the second reflective optical detector is greater than the threshold value of the output value of the first reflective optical detector.

15. The sheet feeder according to claim 1, wherein an amount of elevation of the sheet loader obtained when the output value of the second reflective optical detector becomes equal to or smaller than a threshold value of the second reflective optical detector is smaller than an amount of elevation of the sheet loader obtained when the output value of the first reflective optical detector becomes equal to or smaller than a threshold value of the first reflective optical detector.

16. The sheet feeder according to claim 15, wherein the threshold value of the output value of the second reflective optical detector is greater than the threshold value of the output value of the first reflective optical detector.

17. The sheet feeder according to claim 1, wherein a threshold value of the output value of the second reflective optical detector is greater than a threshold value of the output value of the first reflective optical detector.

18. The sheet feeder according to claim 1,

Wherein a lifting operation of the sheet loader by the loader elevation device and the change of the amount of elevation of the sheet loader are changed according to a state of operation of the air blower.

19. An image forming apparatus comprising:

an image forming device to form an image on a surface of a sheet; and the sheet feeder according to claim 18 to feed the sheet to the image forming device.

20. An image forming system comprising:

an image forming apparatus including an image forming device to form an image on a surface of a sheet; and the sheet feeder according to claim 18 to feed the sheet to the image forming device.

* * * * *